United States Patent [19]

Liede

[11] 4,349,508

[45] Sep. 14, 1982

[54] METHOD FOR STERILIZING CONTAINERS

[75] Inventor: Dieter Liede, Möglingen, Fed. Rep. of Germany

[73] Assignee: Robert Bosch GmbH, Stuttgart, Fed. Rep. of Germany

[21] Appl. No.: 207,052

[22] Filed: Nov. 14, 1980

[30] Foreign Application Priority Data

Aug. 6, 1980 [DE] Fed. Rep. of Germany ..... 3029685

[51] Int. Cl.[3] ..... A61L 2/04; A61L 2/06

[52] U.S. Cl. ..... 422/1; 422/25; 422/26; 422/302; 422/304

[58] Field of Search ..... 422/25, 26, 27, 21, 422/22, 23, 302, 303, 304

[56] References Cited

U.S. PATENT DOCUMENTS 3,494,723 2/1970 Gray ..... 422/21
3,899,862 8/1975 Muys et al. ..... 422/37 X

FOREIGN PATENT DOCUMENTS 2519329 11/1976 Fed. Rep. of Germany ..... 422/26
2839543 3/1980 Fed. Rep. of Germany ..... 422/26

*Primary Examiner*—Barry S. Richman
*Attorney, Agent, or Firm*—Edwin E. Greigg

[57] ABSTRACT

A method and an apparatus are proposed for sterilizing containers before they are filled, with which it is possible to subject heat-sensitive containers to sterilization by a heating medium. While the interior of the containers is subjected to heated vapor, the exterior of the containers is cooled, so that in the wall of the containers the overall temperature of the wall is kept so low that deformation is avoided. To provide such cooling, either a cooling element complemental in shape to the outer contour of the containers, or a coolant-spray device, may be used.

2 Claims, 2 Drawing Figures

METHOD FOR STERILIZING CONTAINERS

BACKGROUND OF THE INVENTION

The invention relates to a method and apparatus for sterilizing containers by introducing heat into the interior of the container.

In a known method, known, for example, from German Offenlegungsschrift No. 28 39 543, a mixture of water vapor and air at a temperature of 250° C. is blown into the interior of the container in order to disinfect it. The heat thus transmitted to the wall of the container can increase the temperature of the wall to such an extent that containers made of plastic are damaged. The attempt is therefore made to attain the desired results using the shortest possible heat-treatment period. The danger here, however, is that an insufficient degree of sterility may result. On the other hand, in containers given a beaker-like form by the thermal deformation of a plastic film, if the heat treatment lasts long enough for sufficient sterilization, re-deformation can occur, because the restoring tensions in the container walls tend to relax with time. This renders the containers unusable, because the container volume is reduced and because the appearance is no longer regular. Excessive heat stress in containers made of multi-layered material can also cause delamination of the layers.

It is accordingly desirable to seek a sterilizing method capable of disinfecting containers to a high degree of sterility, even in the case of thin-walled containers shaped by stretch-molding, in whose walls restoring tensions are present, or of containers made of multi-layered material.

A variant method which avoids performing heat treatments upon the interiors of pre-formed containers, which is disclosed in German Patent No. 23 39 128, is to disinfect the strip of packaging material before it is molded into containers. The degree of sterility attained by this method is quite high; however, it frequently occurs that when the containers are shaped by stretching the strip of packaging material pores will open up on the surface of the material, and these pores can bring about an unsterile state. This occurs especially with strips of packaging material made of mineral-filled or foam-type plastics.

OBJECTS AND SUMMARY OF THE INVENTION

It is an object of the invention to provide a sterilization method for packaging containers which avoids the disadvantages of the known prior art.

It is another object of the invention to provide an apparatus which can simply perform this method.

It is a further object of the invention to provide an apparatus having a simple structure which is easily integrated in an advantageous manner into a packaging machine.

It is a still further object of the invention to provide that the sterile chamber of the packaging machine can be quite small, so that the molding apparatus can remain outside the sterile chamber. Thus the pre-sterilization of the machine before it is put into operation can also be undertaken more simply and easily, because it is precisely the complex shapes of the molding apparatus which require particularly close attention during the pre-sterilization process.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
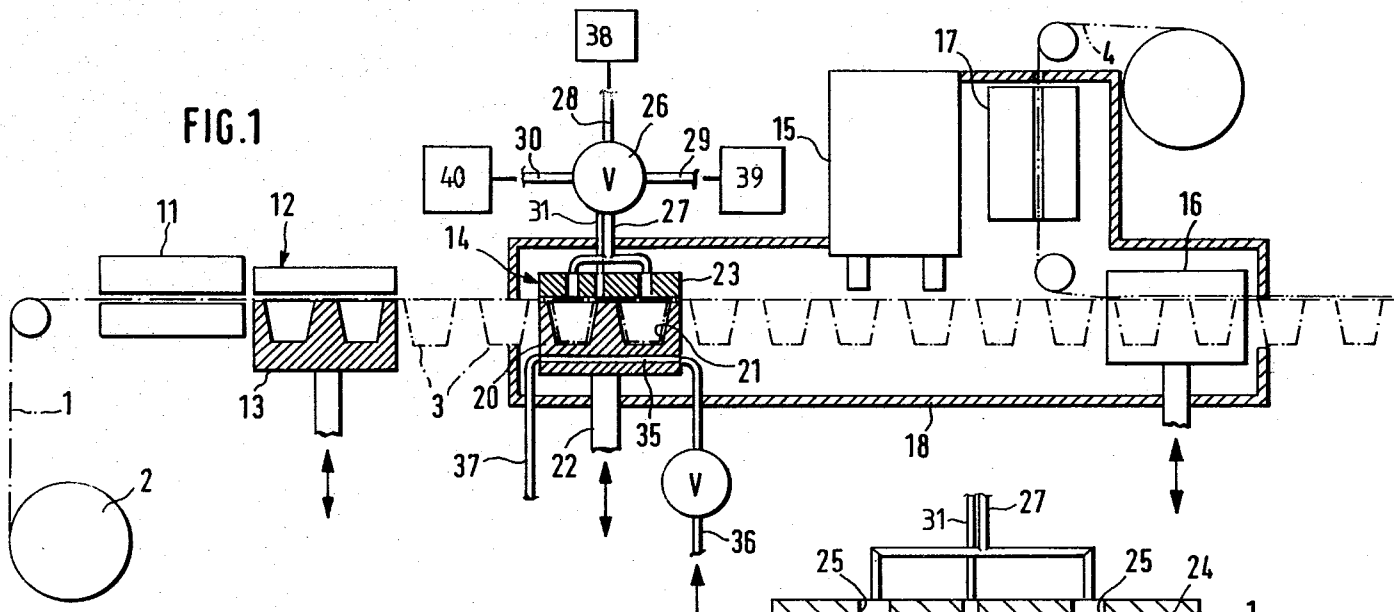
FIG. 1 shows in a simplified longitudinal section a machine for molding, sterilizing, filling and sealing beaker-like containers following the invention.

Referring to FIG. 1, there is shown a strip 1 of thermoplastic material, such as polypropylene or polyvinyl chloride, uncoiling from a supply roll 2, from which strip containers 3 are drawn to form by means of thermal molding. The containers 3, which have a frustoconical shape, are subsequently sterilized on their interior, then filled, sealed with a cover film 4, and finally stamped out of the strip 1.

A packaging machine for performing these steps in processing at sequential stations, to which the strip 1 is moved in steps upon a transport apparatus which is not shown, has a heating device 11 for plasticizing one portion of the strip 1 at a time, a molding device 12 having a matrix 13 for two containers 3 each, a sterilizing apparatus 14, a filling device 15, and a sealing device 16. The sterilization apparatus 14, the filling device 15, the sealing device 16 and a cover-film sterilizing apparatus 17 are housed in a chamber 18, in which a sterile atmosphere is maintained with a degree of overpressure. With the exception of the sterilizing apparatus 14, the other devices on the machine are elements of the prior art, so that it is unnecessary to describe them in further detail here.

The sterilizing apparatus 14, which is equipped to disinfect the already-molded, cup- or breaker-like containers 3, has a cooling element 20 with recesses 21, whose shape is like the external shape of the containers 3, so that a container 3 inserted into the recess rests with its outer wall against the wall of the recess 21. The cooling element 20 preferably has the same shape as the matrix 13 of the molding device 12. For purposes of loading and unloading, the cooling element 20 can be raised and lowered on a rod 22 to which it is secured. The cooling element 20 is pierced by a plurality of channels 35 (only one of which is shown), which are connected to a coolant inflow line 36 and a coolant outflow line 37.

Figure 2:
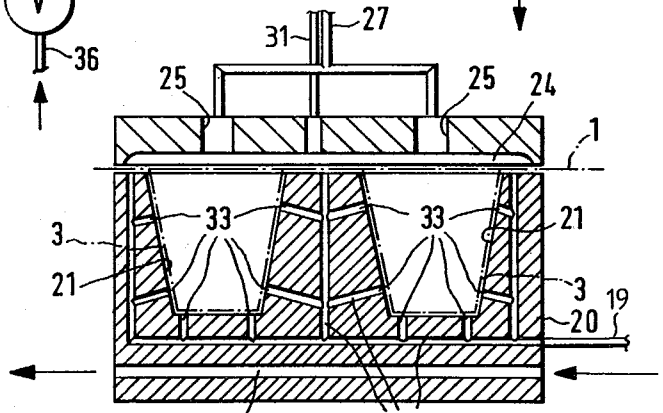
FIG. 2 shows in partial longitudinal section another embodiment of an apparatus for sterilizing containers according to the invention.

As best shown in FIG. 2, several suction bores 33 also discharge into the recesses 21 of the cooling element 20 and communicate via collection bores 34 with a suction line 19. With the interposed film strip 1 having the molded containers 3, the cooling element 20 rests in the operating position against a stationary headpiece 23, which represents a cover for the containers 3 inserted into the recesses 21 of the cooling element 20. The headpiece 23 has a recess 24 on its underside to provide clearance and also has two openings 25 directed into the recesses 21. A line 27 leading to a valve 26 is connected to these openings 25. Connecting lines 28, 29, 30, which lead to a steam generator 38, a sterile-air source 39 and a suction pump 40, also lead to the valve 26. Another line 31 connects the recess 24 of the headpiece to the valve 26 for ventilating air in the beginning of a sterilizing cycle. In order to reduce steam consumption, protrusions can be arranged to project from the headpiece 23 into the recesses 21, these protrusions having a conical form, for instance.

The sterilization method performed by the abovedescribed sterilizing apparatus 14 takes the following course:

With the cooling element 20 in its lowered position, the strip 1 is advanced by one step, so that two previously molded containers 3 at a time are drawn into the sterilizing chamber 18 and located between the headpiece 23 and the cooling element 20. When the cooling element 20 is raised, the containers 3 are introduced into the recesses 21 in a form-fitting manner, then the cooling element is tightly closed by the headpiece 23. A valve 26 connects the inflow line 27 with the steam generator 38, so that water vapor may flow into the interior of the sealed containers 3. Preferably saturated steam is used, having a temperature of 150° C. and a pressure of 5 bar, so that a dwell time of 0.7 seconds suffices to provide sterilization. Because the cooling element 20 is connected to a coolant circuit and the wall of its recesses 21 contacts the inserted containers 3, the interior of the containers 3 is raised to the temperature of sterilization by the steam contacting the inner wall of the containers 3. This temperature of sterilization is so high that the stability of the plastic drops; however, due to a great temperature drop in the wall of the containers, provided by the cooling applied to the exterior, the wall retains sufficient stability to keep its shape. The restoring tensions generated by stretching the strip during the thermal molding of the containers and frozen into the containers by recooling cannot relax during this process. If relaxation were to occur, it could cause an undesirable deformation of the containers 3.

During processing of the containers using steam in an overpressure range, the wall of each container 3 is pressed completely against the wall of the complemental recess 21, so that adequate cooling of the wall of the containers 3 may result. Alternatively, when superheated steam at atmospheric pressure is used, the wall of the containers 3 is drawn by underpressure against the wall of the recesses 21, the underpressure being created by the extraction of the air through the suction bores 33 and the collection bores 34.

After the period during which the steam acts, which is necessary for sterilization and which is shorter when saturated steam is used than when superheated steam is used, the valve 26 closes off the inflow of steam and opens the inflow line 29 for sterile air with a pressure which is somewhat higher than the pressure prevailing in the chamber 18. The sterile air accomplishes the necessary pressure equalization required for lowering the cooling element 20 and for flushing out the vapor-filled containers 3.

If condensation has formed on the inner wall of the containers 3 during this process and, it must be removed before the containers 3 are filled, thus the containers 3 are briefly evacuated before being filled with air. To this end, after the containers have been filled with vapor and before they are filled with air, the valve 26 connects the line 27 with the suction line 30. Both procedures, that is, evacuating the containers and flushing them with sterile air, serve to dry out the condensation on the container wall.

If it is desireable, the containers can be subjected several times in sequence to the treatment described above, in order to attain a very high degree of sterilization; therefore, it is possible to provide at intervals in the direction of travel of the strip 1, several such stations in the machine with sterilizing apparatus of the kind described above or of a similar kind.

It is also conceivable, in the case of containers which are to be provided with a label, that a label be introduced into the recess 21 during each cycle before the cooling element 20 is raised to receive a container 3, with the heat-reactive coating of the label causing the label to adhere to the outside of the container 3 upon the heat treatment.

Instead of the cooling element 20, which as a result of close contact furnishes good heat transfer properties to the wall of the containers, a cooling means can also be used which directs cooling air or cooling water through nozzles against the outside of the containers in a fine spray, while the inside of the containers is filled with vapor. This embodiment, as well, both has a simple structure and brings about good results.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for sterilizing premolded packaging containers having interior and exterior walls, comprising subjecting the interior wall of the container to a heating medium while concurrently subjecting the exterior wall to a cooling medium by applying a force to the pre-molded containers to hold the exterior wall of the container in contact with a cooled body having said cooling medium therein, said force being produced by subjecting the interior and exterior walls of the container to different pressures, the pressure exerted against the interior wall being greater than the pressure exerted against the exterior wall.

2. A method for sterilizing pre-molded packaging containers having interior and exterior walls, comprising subjecting the interior wall of the container to a heating medium while concurrently subjecting the exterior wall to a cooling medium by drawing the exterior wall of the container by underpressure against a cooled body having said cooling medium therein.

* * * * *